US005320924A

United States Patent [19]

Shintaku et al.

[11] Patent Number: 5,320,924

[45] Date of Patent: Jun. 14, 1994

[54] ELECTROSTATIC IMAGE-DEVELOPING TONER AND DEVELOPER

[75] Inventors: Takashi Shintaku, Machida; Kazuhiro Hirama, Fujisawa; Masami Tsurumori, Kamakura, all of Japan

[73] Assignee: Mitsubishi Kasei Corporation, Tokyo, Japan

[21] Appl. No.: 875,289

[22] Filed: Apr. 28, 1992

[30] Foreign Application Priority Data

Apr. 30, 1991 [JP] Japan ..... 3-099111

[51] Int. Cl.[5] ..... G03G 9/097

[52] U.S. Cl. ..... 430/106.6; 430/110

[58] Field of Search ..... 430/110, 109, 106.6

[56] References Cited

U.S. PATENT DOCUMENTS 4,221,856 9/1980 Lu ..... 430/110
4,980,258 12/1990 Aoki et al. ..... 430/110
5,116,713 5/1992 Uchida et al. ..... 430/110

FOREIGN PATENT DOCUMENTS 2014276 10/1970 Fed. Rep. of Germany .

OTHER PUBLICATIONS

Patent Abstracts of Japan, vol. 10, No. 15, (P-422) [2072], Jan. 21, 1986, & JP-A-60 169857, Sep. 3, 1985, Y. Kawagishi, et al., "Electrostatic Charge Image Developing Toner".

Patent Abstracts of Japan, vol. 13, No. 269, (P-888) [3617], Jun. 21, 1989, & JP-A-1 61762, Mar. 8, 1989, R. Tagawa, et al., "Production of Toner for Developing Electrostatic Charge Image".

Kirk-Othmer 'Encyclopedia of Chemical Technology', 3rd edition, vol. 4, 1978, p. 662, "Carbon (Carbon Black)".

Xerox Disclosure Journal, vol. 16, No. 4, Jul./Aug. 1991, p. 267, T. L. Lincoln, et al., "Black Pearls L Carbon Black in Xerographic Toners".

*Primary Examiner*—John Goodrow

*Attorney, Agent, or Firm*—Oblon, Spivak, McClelland, Maier & Neustadt

[57] ABSTRACT

Disclosed herein are an electrostatic image-developing toner comprising a binder resin, a quaternary ammonium salt and an acidic carbon black as colorant, and an electrostatic image developer containing the same.

16 Claims, No Drawings

ELECTROSTATIC IMAGE-DEVELOPING TONER AND DEVELOPER

BACKGROUND OF THE INVENTION

The present invention relates to an electrostatic image-developing toner and a developer containing the same, used for developing electrostatic latent images formed in electrophotography, electrostatic recording, etc.

The developer used for electrocopiers, etc. is once deposited on an image carrier such as a photoreceptor on which an electrostatic image has been formed, in the developing step, then the deposited developer is transferred from the photoreceptor to a transfer sheet in the transfer step and the transferred developer is finally fixed on a copying paper in the fixing step. As the developer used for developing the electrostatic image formed on a latent image carrier, there are known two-component developer comprising a carrier and a toner, and one-component developer (magnetic toner) which requires no carrier.

For preparing a toner which is positively charged, a method is known in which a charge-imparting agent is added either internally or externally to a binder resin and a colorant. As the charge-imparting agent, there are known, for instance, Nigrosine dye, triaminophenylmethane compounds and quaternary ammonium salts.

Among the said charge-imparting agents, the quaternary ammonium salts, as compared with other agents such as Nigrosine dye, have advantages that they can be used for color toner as they are colorless and that they maintain good charging stability in continuous copying operations. But, on the other hand they have a drawback that the amount of the charge imparted is relatively small.

As the carrier used in combination with toner in development using a two-component developer, there are known iron powder, ferrite powder and the like. Ferrite powder is low in charge-imparting performance in comparison with iron powder.

Thus, in case of using a toner containing a quaternary ammonium salt, or in the case of a developer comprising the said quaternary ammonium salt-containing toner and a carrier composed of a ferrite powder, there has been the problem that no sufficient charge could be obtained, and especially in the case of using under a high temperature and high humidity conditions or in continuous copying operation, the charge was apt to decrease, causing to make background (BKG) level high or making it unable to obtain a stabilized copy density. Particularly at a time just after start of operation of a copying machine, as in the morning, it would be experienced that the copies be blotted in black due to increase of the BKG level or the brush marks be formed on the solid black of the copy.

As a result of strenuous studies for solving these technical problems, it has been found that by incorporating into a toner containing a quaternary ammonium salt, an acidic carbon black whose use as a component of a positively charged toner has rather been avoided since it is in itself an electron acceptive substance and has the nature to be charged negatively, the obtained developer shows an excellent charging characteristics and is capable of providing excellent image quality and durability. The present invention has been attained on the basis of this finding.

SUMMARY OF THE INVENTION

In a first aspect of the present invention, there is provided an electrostatic image-developing toner comprising a binder resin, a quaternary ammonium salt and an acidic carbon black.

In a second aspect of the present invention, there is provided an electrostatic image developer comprising a toner defined in the 1st aspect and a resin-coated ferrite powder as carrier.

The object of the present invention is to provide an electrostatic image-developing toner and a developer containing such a toner, the said developer being excellent in static charging characteristics and having little probability of causing a change of image quality with passage of time and suffering deterioration by environmental factors.

DETAILED DESCRIPTION OF THE INVENTION

As the quaternary ammonium salt used in the present invention, various ones which are suitable as a component of electrostatic image-developing toner, are usable. In particular, salt-forming compounds of quaternary ammonium salts and sulfonic acids, represented by the following formulae (I) and (II) are preferred.

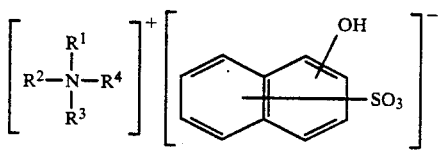

(I)

(wherein $R^1$, $R^2$, $R^3$ and $R^4$ each represents a substituted or non-substituted alkyl group, preferably a substituted or non-substituted alkyl group having 1 to 18 carbon atoms, or a substituted or non-substituted aralkyl group, preferably a substituted or non-substituted aralkyl group having 7 to 15 carbon atoms.)

As the substituent(s) of the said alkyl group, nitro group, methyl group and chlorine atom may be exemplified.

As the substituent(s) of the said aralkyl group, nitro group, methyl group and chlorine atom may be exemplified. It is especially preferred that $R^1$ is an alkyl group of 1 to 8 carbon atoms, $R^2$ and $R^3$ are each an alkyl group of 1 to 18 carbon atoms, and $R^4$ is an alkyl group of 1 to 8 carbon atoms or a benzyl group.

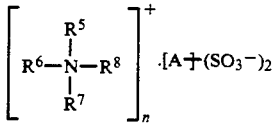

(II)

(wherein $R^5$ and $R^7$ are each a substituted or non-substituted alkyl group, preferably a substituted or non-substituted alkyl group having 1 to 8 carbon atoms, or a substituted or non-substituted aralkyl group, preferably a substituted or non-substituted aralkyl group having 7 to 15 carbon atoms; $R^6$ and $R^8$ are each a substituted or non-substituted alkyl group, preferably a substituted or non-substituted alkyl group having 1 to 30 carbon atoms, or a substituted or non-substituted aralkyl group, preferably a substituted or non-substituted aralkyl group having 7 to 15 carbon atoms; A represents a benzene ring which may have a substituent(s) or a naphthalene ring which may have a substituent(s), and n is an integer of 2 or more, preferably 2 or 3.)

As the substituent(s) of the said alkyl group, nitro group, methyl group and chlorine atom may be exemplified.

As the substituent(s) of the said aralkyl group, nitro group, methyl group and chlorine atom may be exemplified.

As the substituent(s) of the said benzene ring and naphthalene ring, hydroxyl group, amino group and ($C_1$–$C_4$) alkyl group may be exemplified. Among them, hydroxyl group is preferred. Each of the said rings may have two or more substituents.

It is especially preferred that $R^5$ and $R^7$ are each a methyl group and the total number of carbon atoms possessed in $R^6$ and $R^8$ is 13 or more, preferably 19 to 40, more preferably 30 to 40.

Examples of the compounds represented by the formula (I) include those of the following formulae:

(1)

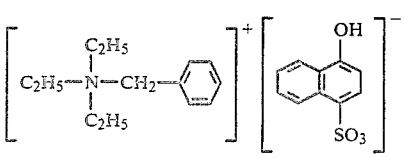

(2)

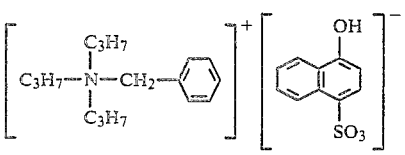

(3)

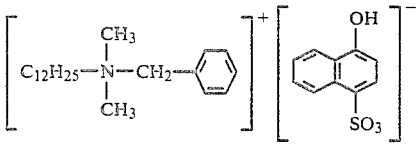

(4)

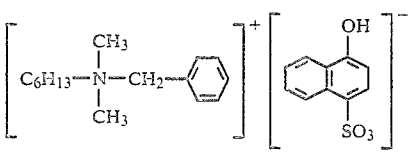

-continued (5)

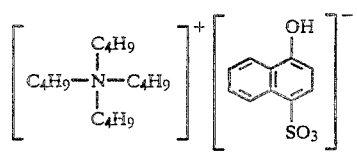

(6)

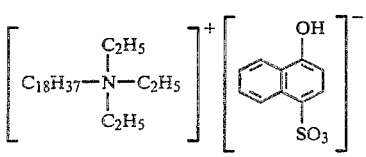

(7)

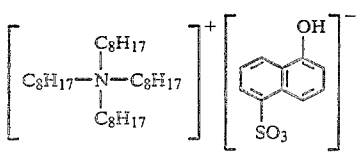

(8)

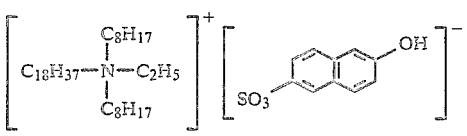

(9)

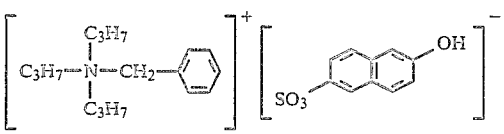

(10)

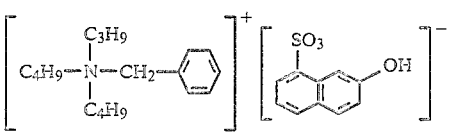

(11)

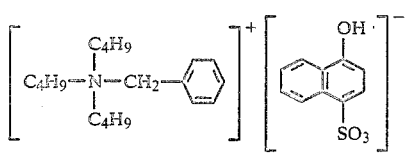

Examples of the compounds represented by the formula (II) include those of the following formulae:

(12)

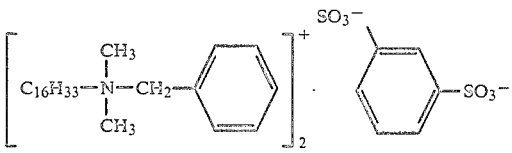

(13)

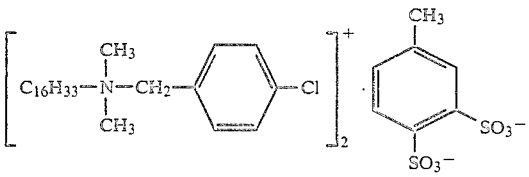

-continued
(14)
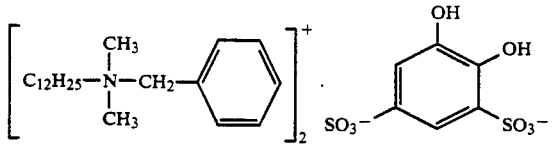
(15)
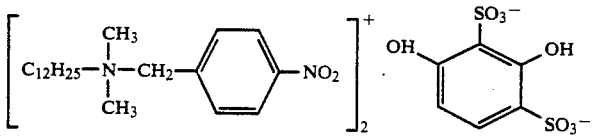
(16)
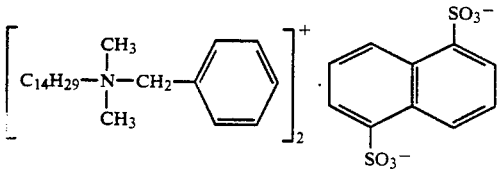
(17)
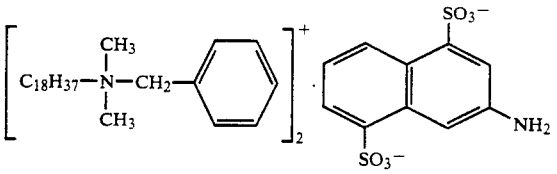
(18)
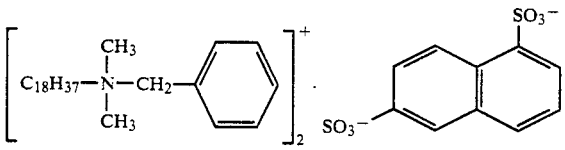
(19)
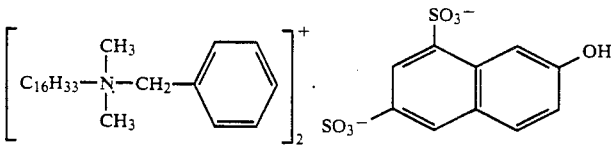
(20)
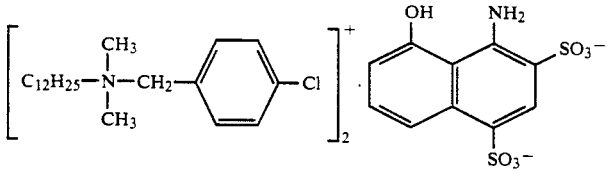
(21)
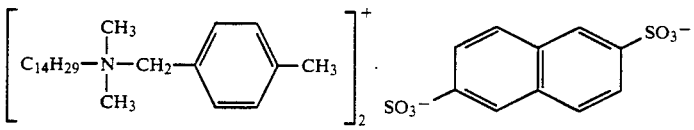
(22)
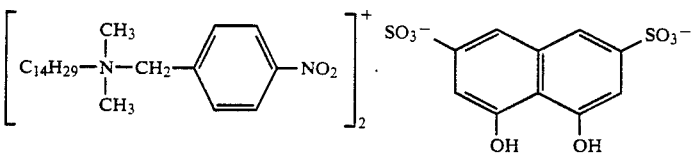

-continued (23)

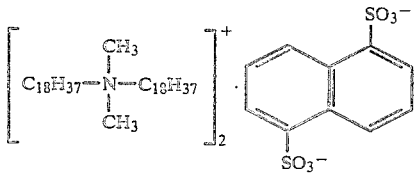

(24)

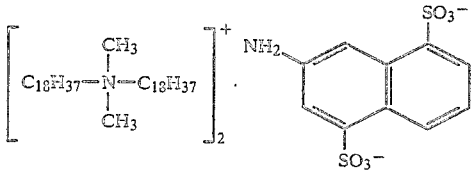

(25)

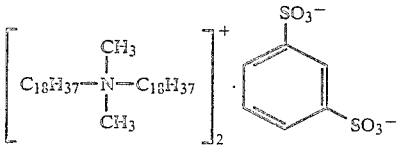

(26)

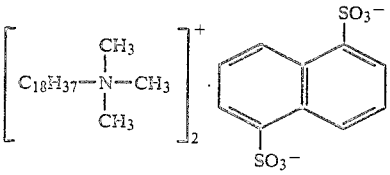

(27)

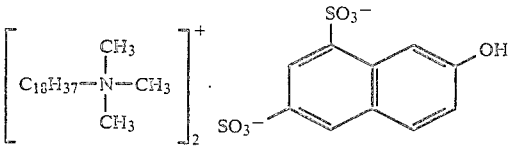

(28)

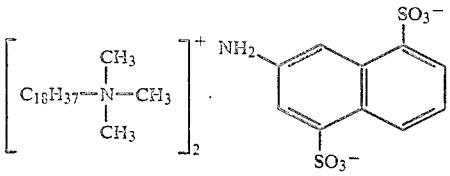

The binder resin used in the present invention can be selected from various known ones. For example, there can be used styrene resins (homopolymer or copolymer containing styrene or styrene substituents) such as polystyrene, crotopolystyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic ester copolymers (such as styrene-methyl acrylate copolymer, styrene-ethyl acrylate copolymer, styrene-butyl acrylate copolymer, styrene-octyl acrylate copolymer and styrene-phenyl acrylate copolymer), styrene-methacrylic ester copolymers (such as styrene-methyl methacrylate copolymer, styrene-ethyl methacrylate copolymer, styrene-butyl methacrylate copolymer and styrene-phenyl methacrylate copolymer), styrene-α-methyl chloroacrylate copolymer and styrene-acrylonitrile-acrylic ester copolymer; vinyl chloride resin; rosin-modified maleic acid resin; phenol resin; epoxy resin; polyester; low-molecular weight polyethylene; low-molecular weight polypropylene; ionomer resin; polyurethane; silicone resin; ketone resin; ethylene-ethyl acrylate copolymer; xylene resin; and polyvinyl butyral. The especially preferred resins in the present invention are styrene-acrylic ester copolymers, styrene-methacrylic ester copolymers, saturated or unsaturated polyesters and epoxy resins. These resins may be used either singly or in mixtures.

The content of the quaternary ammonium salt in the toner is 0.1 to 10 parts by weight, preferably 0.2 to 6 parts by weight based on 100 parts by weight of the binder resin. When the content of the quaternary ammonium salt is too small, it is difficult to obtain the expected effect of improving the charging characteristics, and when the said content is too large, it tends to deteriorate the produced toner in quality.

As colorant used in the present invention, an acidic carbon black produced according to the furnace process may be exemplified. It is especially preferred an acidic-type carbon black having a pH of 2 to 4. The colorant content is 3 to 20 parts by weight, preferably 4 to 10 parts by weight based on 100 parts by weight of the resin.

As the acidic-type furnace-process carbon blacks used in the present invention, MA-7, MA-8, MA-11, MA-100, #1000, #2200B, #2350 and #2400B (which are produced by Mitsubishi Kasei Corp.); MOGUL L, REGAL 400R and MONARCH 1000 (which are produced by Cabot Corp.); and 1035, 1040, 1255 and 3500 in RAVEN (produced by Columbia Corp.) The acidic carbon black having a specific surface area (as measured by BET method) of 25–400 $m^2/g$ and a dibutyl phthalate (DBP) absorption of 40–140 ml/100 g is preferably used. For good dispersion into the binder resin at the time of toner kneading, it is more preferred an acidic carbon black having a specific surface area of 80–150 $m^2/g$ and a DBP absorption of 50–120 ml/100 g. Also, an acidic carbon black which has been treated with a metal salt of a carboxylic acid having a melting point of 70°–250° C. may be added.

The toner of the developer according to the present invention may contain, in addition to a quaternary ammonium salt, other charge controlling agents such as polyamine resin, Nigrosine dye, triaminotriphenylmethane compounds and the like. The content of such other charge controlling agents is preferably not more than the content of the quaternary ammonium salt.

The said toner may further contain other additives for improving fixing property such as low-molecular weight olefin polymers, for example, polyethylene and polypropylene. The content of the low-molecular weight olefin polymer is preferably 0.5 to 10% by weight.

The said toner may further contain other additives for flowability of the toner such as fine silica powder, alumina, and titania. The contents of the silica powder is preferably 0.05 to 5% by weight.

For the preparation of the toner, the said component materials are mixed by a header or other suitable means and the resultant mixture is cooled, pulverized and classified. The average particle size of the obtained toner is preferably in the range of 5 to 20 μm.

The developer of the present invention preferably comprises a mixture of a toner produced in the manner described above and a carrier comprising ferrite powder having the particle surfaces coated with a resin. As the coating resin for the ferrite powder, there can be used, for example, fluorine resins, silicone-based resins, acrylic resins, styrene resins, epoxy resins, polyesters and polyamides.

As the carrier for the developer of the present invention, it is preferred to use ferrite powder coated with a silicone-based resin such as a silicone resin, a methyl silicone-containing resin, a phenyl silicone-containing resin, a mixture thereof, etc.

The coat of ferrite powder may be of either a monolayer structure or multi-layer structure. It is preferable that at least the uppermost layer of the coat is composed of the silicone resin, the methyl silicone-containing resin, the phenyl silicone-containing resin or the mixture thereof. The silicone resin is giant molecules expanding in a network structure and having the silicon atoms bonded to each other through siloxane bond. The silicon atom merely bonded to not more than 3 of other silicon atoms through siloxane bond in the surface of the giant molecule usually has hydroxyl groups. The resin in which these hydroxyl groups are at least partly replaced with methyl group or methyl and phenyl groups, is here called a methyl silicone-containing resin or a phenyl silicone-containing resin.

The particle size of the carrier used in the present invention is not specifically defined, but a preferable average particle size is 10 to 200 μm. The mixing ratio of the carrier is 5–100 parts by weight based on 1 part by weight of the toner of the present invention.

The electrostatic image developer of the present invention shows an excellent charging performance such as always moderate and stabilized charging property. It can minimize BKG level or change of image density in a copying operation under a high temperature and high humidity conditions, in a continuous copying operation or in an intermittent copying operation, which are called in question in the past. Especially, it can prevent occurrence of increasing the BKG level in the copying operation after allowing to stand and can minimize change of copied image quality. Thus, the developer according to the present invention is capable of forming good images irrespective of use conditions and its industrial benefit is immense.

EXAMPLE

The present invention will hereinafter be described in further detail by showing the examples thereof. It is to be understood, however, that these examples are merely intended to be illustrative and not to be construed as limiting the scope of the invention.

In the following descriptions of the Examples, all "parts" are "part by weight" unless otherwise noted.

EXAMPLE 1

100 parts of styrene-n-butyl acrylate copolymer (monomeric weight ratio of styrene/n-butyl acrylate=82/18), 5 parts of an acidic carbon black (MA-7, produced by Mitsubishi Kasei Corp., pH=3.0), 2 parts of a charge controlling agent composed of a quaternary ammonium salt [compound of the formula (11)] and 2 parts of a low-molecular weight polypropylene (Viscol 550P, produced by Sanyo Chemical Co., Ltd.) were blended, headed, pulverized and classified to obtain a black toner having an average particle size of 10 μm. To 100 parts of the thus-obtained black toner were externally added and mixed 0.2 parts of silica powder (R-972, produced by Nippon Aerosil Co., Ltd.) and 0.3 parts of magnetite powder (EPT-1000, produced by Toda Kogyo Corp.) by a Henschel mixer. 4 parts of the resultant mixture and 100 parts of a carrier composed of ferrite powder coated on the particle surfaces with methyl silicone-containing resin (an average particle size=about 100 μm) were mixed and stirred to prepare a developer.

This developer was subjected to a 100,000-sheet copying test under a condition of 40° C. and 85–90% RH by using a copying machine employing an organic photoconductor as photoreceptor. The 100,000-sheet copying test was conducted by repeating 10 times the daily operating cycle of continuous copying of about 10,000 sheets and overnight (about 10-hour) suspension of operation.

As a result, there was noted almost no change of image density and amount of charge during and after continuous copying of 10,000 sheets, and also there was no change of the BKG level in operation after overnight suspension (standing to stand for overnight).

Further, even after copying of 100,000 sheets, there was observed no increase of BKG level of the copy, and the uniformity and density of the solid black of the copy were also high.

EXAMPLE 2

A developer was prepared in the same procedure as Example 1 except that the carrier used was the one prepared by mixing 80 parts of a ferrite powder coated with methyl silicone-containing resin and 20 parts of a ferrite powder coated with phenyl silicone-containing resin. This developer was subjected to the 100,000-sheet copying test under a high temperature and high humidity conditions. There was seen no increase of the BKG lrvel, and the uniformity and density of the solid black of the copy were high. The developer was also excellent in durability.

EXAMPLES 3-6

Developers were prepared in the same way as Example 1 except for using the acidic carbon black as shown in Table 1. The thus-obtained each developer was subjected to the 100,000-sheet copying test under a high temperature and high humidity conditions. There was no increase of the BKG level, and the uniformity and density of the solid black ground of the copy were high. The developers were also excellent in durability.

COMPARATIVE EXAMPLES 1 AND 2

Developers were prepared in accordance with Example 1 except for using the carbon black as shown in Table 1. These obtained developers were subjected to the 100,000-sheet copying test under a high temperature and high humidity conditions. As a result, there were noted large changes of image density, large increase of the BKG level and large change of the tribocharge in the course of continuous copying. Especially, the increase of the BKG level after overnight suspension rose sharply, and the brush marks were formed on the black ground of the copy. Thus, these developers could not stand normal use.

| | Acidic carbon black | | | | |
|---|---|---|---|---|---|
| | Kind | pH | Amount added (wt parts) | Level of BKG of a 10,000th copy | Level of BKG of a 1st copy after overnight suspension |
| Example 1 | MA-7 (Mitsubishi Kasei Corp.) | 3.0 | 5 | ◎ | ○ |
| Example 2 | MA-7 (Mitsubishi Kasei Corp.) | 3.0 | 5 | ◎ | ○ |
| Example 3 | MA-100 (Mitsubishi Kasei Corp.) | 3.5 | 5 | ◎ | ○ |
| Example 4 | #1000 (Mitsubishi Kasei Corp.) | 3.0 | 4 | ◎ | ○ |
| Example 5 | RAVEN 1255 (Columbia Corp.) | 2.5 | 5 | ○ | ○ |
| Example 6 | REGAL 400R (Cabot Corp.) | >4.0 | 5 | ○ | ○ |
| Comp. Example 1 | #45 (Mitsubishi Kasei Corp.) | 8.0 | 5 | ○ | X |
| Comp. Example 2 | #850 (Mitsubishi Kasei Corp.) | 8.0 | 4 | ○ | X |

Notes:

The Level of Background (BKG)

(i) In 10,000-sheet continuous copying, under a condition of 40° C. and 85-90% RH, the level of BKG in the first copy, 5,000th copy and 10,000th copy were measured. BKG was measured by NIPPON DENSHOKU COLOR & COLOR DIFFERENCE METER (ZΣ80).

| BKG = $W_b$ (copied) − $W_b$ (befor copy) | |
|---|---|
| BKG less than 0.5 | ◎ |
| BKG of from 0.5 to 1.0 | ○ |
| BKG of from 1.0 to 1.5 | Δ |
| BKG more than 1.5 | X |

(ii) The level of BKG in the first copy after overnight (about 10 hrs) suspension was measured.

Remarks

In Comparative Examples, the difference of the level between the 10,000th copy and the 1st copy overnight suspension was noticed.

What is claimed is:

1. An electrostatic image developer comprising:

(A) a toner comprising:

(i) a binder resin, (ii) a quaternary ammonium salt; and (iii) an acidic carbon black; and (B) a carrier comprising ferrite powder having a layer composed of silicon-based resins.

2. The developer of claim 1, wherein said toner comprises 0.1-10 parts by weight of said quaternary ammonium salt and 3-20 parts by weight of said acidic carbon black, each based on 100 parts by weight of said binder resin.

3. The developer of claim 1, wherein said acidic carbon black is one produced by the furnace process.

4. The developer of claim 1, wherein said acidic carbon black has a pH of 2 to 4.

5. The developer of claim 1, wherein the specific surface area of said acidic carbon black as measured by the BET method is 25 to 400 $m^2/g$, and the dibutyl phthalate absorption of said acidic carbon black is 40 to 140 ml/100 g.

6. The developer of claim 1, wherein at least a part of said acidic carbon black is one treated with a metal salt of a carboxylic acid.

7. The developer of claim 1, wherein said quaternary ammonium salt is a compound represented by the following formula (I):

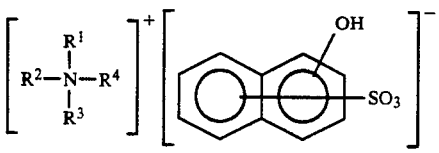

(I)

wherein $R^1$, $R^2$, $R^3$ and $R^4$ represent independently a substituted or unsubstituted alkyl group, or a substituted or unsubstituted aralkyl group.

8. The developer of claim 7, wherein $R^1$ is an alkyl group having 1 to 8 carbon atoms, $R^2$ and $R^3$ are each an alkyl group having 1 to 18 carbon atoms, and $R^4$ is an alkyl group having 1 to 8 carbon atoms or a benzyl group.

9. The developer of claim 1, wherein said quaternary ammonium salt is a compound represented by the following formula (II):

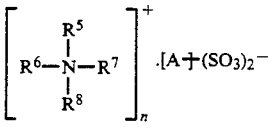

(II)

wherein $R^5$, $R^6$, $R^7$ and $R^8$ represent independently a substituted or unsubstituted alkyl group, or a substituted or unsubstituted aralkyl group; A represents a benzene ring which may have a substituent(s) or a naphthalene ring which may have a substituent(s); and n represents an integer of 2 or more.

10. The developer of claim 9, wherein $R^5$ and $R^7$ are each a methyl group, and the total number of carbon atoms possessed by $R^6$ and $R^8$ is 13 or more.

11. The developer of claim 1, wherein said toner further comprises a low-molecular weight polyolefin.

12. The developer of claim 1, wherein said toner further comprises silica powder.

13. The developer of claim 1, wherein said ferrite powder has, as the uppermost coating layer of its particle surface, a layer composed of silicon-based resins.

14. The developer of claim 1, wherein said ferrite powder has, as the uppermost coating layer of its particle surface, a layer composed of one member selected from the group consisting of a silicone resin, a methyl silicon-containing resin, a phenyl silicon-containing resin and mixtures thereof.

15. The developer of claim 1, wherein the content of said ferrite powder is 5–100 parts by weight based on 1 part by weight of said toner.

16. An electrostatic image-developing toner comprising:

(i) a binder resin, (ii) a quaternary ammonium salt of formula (I) or (II):

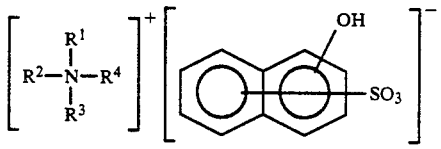

(I)

wherein $R^1$, $R^2$, $R^3$ and $R^4$, which may be identical or different, are each a substituted or unsubstituted alkyl group or a substituted or unsubstituted aralkyl group;

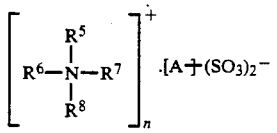

(II)

wherein $R^5$, $R^6$, $R^7$ and $R^8$, which may be identical or different, are each a substituted or unsubstituted alkyl group or a substituted or unsubstituted aralkyl group; A is a benzene ring which may have a substituent(s) or a naphthalene ring which may have a substitutent(s); and n is 2 or 3; and (iii) an acidic carbon black.

* * * * *

UNITED STATES PATENT AND TRADEMARK OFFICE

CERTIFICATE OF CORRECTION

PATENT NO. : 5,320,924

DATED : June 14, 1994

INVENTOR(S) : SHINTAKU ET AL

It is certified that error appears in the above-identified patent and that said Letters Patent is hereby corrected as shown below:

| Col. | Line | |
|---|---|---|
| 12, | 23, | Claim 1, delete "silicon-based" and insert --silicone-based--; |
| 14, | 3, | Claim 13, delete "silicon-based" and insert --silicone-based--; |
| 14, | 8, | Claim 14, delete "silicon-containing" (both instances) and insert --silicone-containing--. |

Signed and Sealed this

Eighteenth Day of October, 1994

Bruce Lehman

*Attest:*

BRUCE LEHMAN

*Attesting Officer*

*Commissioner of Patents and Trademarks*